United States Patent [19]

Aoki et al.

[11] Patent Number: 4,874,913

[45] Date of Patent: Oct. 17, 1989

[54] LUMINOUS ELEMENT HOLDING STRUCTURE FOR AN ILLUMINATED KEY SWITCH

[75] Inventors: Kazuo Aoki; Sadao Tachibana, both of Tokyo, Japan

[73] Assignee: Oki Electric Industry Co., Ltd., Tokyo, Japan

[21] Appl. No.: 189,134

[22] Filed: Apr. 22, 1988

[30] Foreign Application Priority Data

Apr. 30, 1987 [JP] Japan ..... 62-65340[U]

[51] Int. Cl.[4] ..... H01H 9/16; F21V 33/00

[52] U.S. Cl. ..... 200/314; 362/85; 362/800

[58] Field of Search ..... 362/23, 85, 95, 800; 200/5 A, 314, 315, 317, 159 R; 400/472, 477, 479

[56] References Cited

U.S. PATENT DOCUMENTS

| | | | |
|---|---|---|---|
| 3,849,621 | 11/1974 | Habecker | 200/314 |
| 3,909,564 | 9/1975 | Scheingold et al. | 400/479 |
| 4,445,164 | 4/1984 | Giles, III et al. | 362/85 |
| 4,563,550 | 1/1986 | Bertina | 200/314 |

*Primary Examiner*—Ira S. Lazarus
*Assistant Examiner*—David G. Messer
*Attorney, Agent, or Firm*—Wenderoth, Lind & Ponack

[57] ABSTRACT

A luminous element holding structure for an illuminated key switch arrangement includes a key having a transparent window, a housing for containing switch operating members, the housing having a recess, a flange and a pair of catches, a holding plate provided with through holes each for receiving the lower portion of the housing, a base plate, a switch element having pairs of switch contacts, and pairs of fixed electrodes each for conducting current to a luminous element, and a luminous element holder disposed in the recess of the housing. The lead wires of a luminous element are inserted forcibly in through holes formed in a pair of conductive members of the luminous element holder so that the luminous element is held firmly by the luminous element holder. The luminous element holder is set in the recess of the housing and the key is combined with the housing so that the transparent window is located opposite to the luminous element held on the luminous element holder. The housing is placed on the holding plate so that the lower portion thereof is received in the through hole and the flange is seated on the surface of the holding plate. The holding plate is combined with the base plate so that the conductive members of the luminous element holder are pressed, respectively against the pair of fixed electrodes to connect the luminous element eletrically to the pair of fixed electrodes.

3 Claims, 5 Drawing Sheets

FIG.6 (A) (PRIOR ART)
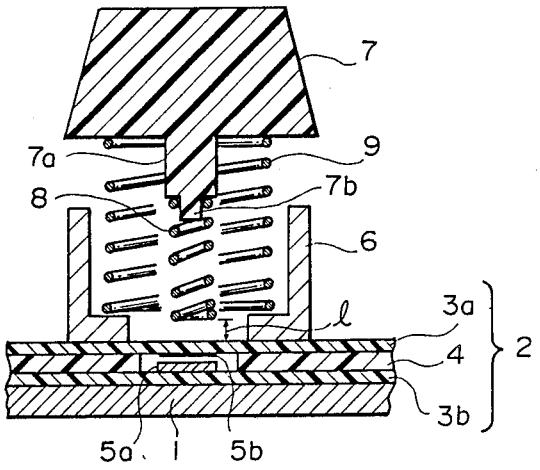
FIG. 6 (B) (PRIOR ART)
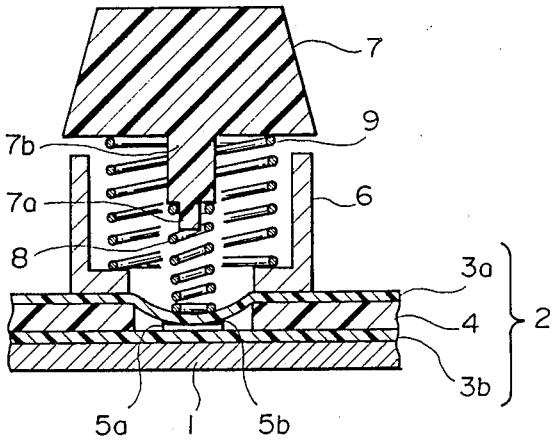

LUMINOUS ELEMENT HOLDING STRUCTURE FOR AN ILLUMINATED KEY SWITCH

BACKGROUND OF THE INVENTION

1. Field of the Invention:

The present invention relates to a luminous element holding structure for holding a luminous element such as a light emitting diode (hereinafter referred to as "LED") in combination with a key switch, for example, of a keyboard having a plurality of such key switches.

2. Description of the Prior Art:

A conventional key switch employing a membrane switch element is shown in FIGS. 6(A) and 6(B). The key switch is in a closed state in FIG. 6(A) and is in an open state in FIG. 6(B). In FIGS. 6(A) and 6(B), there are shown a base plate 1, a membrane switch element 2 provided on one side of the base plate 1, a tubular housing 6 having an open upper end and a bottom wall provided with a through hole, and mounted on the membrane switch element 2, a key 7 including a key head having a substantially prismoidal shape and a stem 7*b* projecting downward from the center of the key head and having a relatively small tip 7*a*, a small coil spring 8 having a relatively small diameter and having one end fitted on the tip 7*a* of the key 7, and a large coil spring 9 having a comparatively large diameter. The large coil spring 9 is provided in the housing 6 so that one end thereof is in contact with the lower surface of key head of the key 7 and the other end thereof is in contact with the bottom surface of the housing 6 to hold the key 7 at an upper position and to space the lower end of the small coil spring 8 from the membrane switch element 2 by a gap l.

The membrane switch element 2 comprises two flexible films 3*a* and 3*b*, a spacer 4 held between the flexible films 3*a* and 3*b* and provided with a plurality of through holes to form spaces between the flexible films 3*a* and 3*b*, a fixed contact 5*a* attached to the upper surface of the lower flexible film 3*b*, namely, the flexible film below the spacer 4, within each through hole, and a movable contact 5*b* disposed opposite the fixed contact 5*a* and attached to the lower surface of the upper flexible film 3*a*, namely, the flexible film over the spacer 4. The small coil spring 8 is disposed upright directly above the fixed contact 5*a* and the movable contact 5*b*.

When the key 7 is depressed, the large coil spring 9 is compressed to bring the lower end of the small coil spring 8 into contact with the flexible film 3*a* of the membrane switch element 2. As the key 7 is depressed further, the large coil spring 9 is compressed further and the small coil spring 8 is also compressed to apply pressure to the upper flexible film 3*a*. Then, the upper flexible film 3*a* is flexed by the small coil spring 8 into a shape as shown in FIG. 6(B), so that the movable contact 5*b* provided on the upper flexible film 3*a* opposite the fixed contact 5*a* is brought into contact with the fixed contact 5*a* to close the key switch.

When the key 7 is released, the compressed coil springs 8 and 9 are allowed to recover their original shapes, the small coil spring 8 is separated from the flexible film 3*a* by the gap l, the flexed flexible film 3*a* is allowed to recover its original shape, and thus, the movable contact 5*b* is separated from the fixed contact 5*a* to open the key switch.

There is a proposed pilot lamp structure which illuminates luminous element such as an LED to indicate the correct contact of the movable and fixed contacts of a key switch when the key of the key switch is depressed, to ensure the correct operation of a membrane keyboard having key switches including a membrane switch element having pairs of contacts which are brought into electrical contact through the component film of the membrane switch element by the keys. A conventional LED holding structure for holding an LED on such a membrane keyboard will be described hereinafter.

FIG. 7 is an exploded perspective view of a conventional LED holding structure, and FIG. 8 is a sectional view of the assembled LED holding structure of FIG. 7.

Referring to FIGS. 7 and 8, an LED 10 has two lead wires 10*a* vertically extending downward and each bent substantially at the middle thereof at a right angle. An LED holder 11 comprises a cruciform-shaped insulating member 12 having a head 12*a*, and a pair of conductive members 13 attached respectively to the opposite sides of the vertical leg of the insulating member 12 and each having a groove 13*a*. A holding plate 14 has holes respectively corresponding to housings 6 and keys 7. A slit 14*a* for receiving the head 12*a* of the LED holder 11 is formed in the edge of the holding plate 14 defining each such hole.

Referring to FIG. 9, in a membrane switch element 2, which is the same as the membrane switch element 2 shown in FIGS. 6(A) and 6(B), a portion of the upper flexible film 3*a* and a portion of the spacer 4 are removed at a predetermined position to form a hole 15 for receiving the LED holder 11. Fixed electrodes 16 are arranged in the hole 15 on the lower flexible film 3*b* so as to cooperate with the conductive members 13 of the LED holder 11.

To mount these parts on a base plate 1, the bent portions of the lead wires 10*a* of the LED 10 are inserted, respectively, in the grooves 13*a* of the conductive members 13 of the LED holder 11 to combine the LED 10 and the LED holder 11. Then, the head 12*a* of the insulating member 12 of the LED holder 11 is inserted in the slit 14*a* of the holding plate 14. Then, the LED holder 11 is inserted in the hole 15 formed in the membrane switch element 2 and is adhesively attached to the upper surface of the base plate 1 so that the conductive members 13 of the LED holder 11 are pressed respectively against the fixed electrodes 16 formed on the membrane switch element 2 to connect the LED 10 electrically to the fixed electrodes 16. Thus, the LED 10 is mounted on the membrane keyboard as shown in FIG. 8.

When the key 7 is depressed to close the key switch, the fixed electrodes 16 are connected to a power supply, whereby the LED 10 lights up to indicate that the key switch is positively closed.

Referring to FIGS. 10 and 11 showing another conventional LED holding structure, a pair of lead wires 17*a* extends downward from the luminous head of an LED 17. An LED holder 18 is formed of insulating material and has a cylindrical shape with a length smaller than the length of the lead wires 17*a* of the LED 17. The LED holder 18 is provided with a pair of through holes 18*a* for respectively receiving the lead wires 17*a* of the LED 17, and has a threaded hole 18*b* extending at a predetermined location in the lower surface thereof. A hole 19 having a shape complementary to the external shape of the LED holder 18 extends through the upper flexible film 3*a* and spacer 4 of a membrane switch element 2. A pair of fixed electrodes 20 are provided on the upper surface of the flexible film 3b of a membrane switch element 2, namely, at the bottom of the hole 19, so as to respectively contact the pair of lead wires 17a of the LED 17. A through hole 21 is open to the hole 19 and extends through a base plate 1 and the lower flexible film 3b of the membrane switch element 2 at a location aligned with the threaded hole 18b of the LED holder 18.

To mount the LED 17 and the LED holder 18 on the base plate 1, the lead wires 17a of the LED 17 are inserted, respectively, in the through holes 18a of the LED holder 18 and then the respective free ends of the lead wires 17a projecting from the lower surface of the LED holder 18 are bent at a right angle to combine the LED 17 and the LED holder 18. Then, the LED holder 18 is placed in the hole 19 and on the lower flexible film 3b so that the bent portions of the lead wires 17a respectively contact the fixed electrodes 20 provided on the lower flexible film 3b of the membrane switch element 2, and then a screw 22 is inserted through the through hole 21 from below the base plate 1 adhesively attached to the lower surface of the membrane switch element 2 and is screwed in the threaded hole 18b of the LED holder 18 to fasten the LED holder 18 through the membrane switch element 2 to the base plate 1. Thus, the bent portions of the lead wires 17a of the LED 17 are respectively pressed against the fixed electrodes 20 for providing an electrical connection.

Both the conventional LED holders 11 and 18 are formed of an elastic material and are pressed when mounted on the membrane switch element to provide a stable electrical connection of the lead wires of the LED and the fixed electrodes. In the conventional membrane keyboard, every key switch is not necessarily provided with an LED. Rather, only some of the key switches provided on the keyboard are provided with LEDs.

However, the foregoing conventional LED holding structures have the following drawbacks.

To combine the former conventional LED holder 11 and an LED, the lead wires of the LED have to be bent at a right angle each at the middle thereof, which contributes to an increase in the cost associated with manufacturing the structure. Furthermore, when only some of the key switches of the keyboard are to be provided with LEDs while the rest of the key switches are not, two kinds of through holes, namely, through holes each having a shape conforming to the external shape of the key and provided with the slit for receiving the head of the LED holder 11 therein and through holes each having a shape conforming only to the external shape of the key, must be punched in the holding plate 14. Therefore, two different tools are necessary for punching these different through holes. If a key switch originally not provided with an LED is required to be provided with one, the holding plate needs to be replaced with another holding plate because the through hole for the key switch is not provided with the slit for receiving the head of the LED holder. Still further, since the LED holder is loosely joined to the bracket simply by fitting the head thereof in the slit formed in the holding plate, the LED holder is liable to be dislocated when subjected to vibrations or shocks entailing faulty contact between the lead wires of the LED and the fixed electrodes.

To combine the latter conventional LED holder 18 and an LED, the free ends of the lead wires of the LED projecting from the lower surface of the LED holder need to be bent, which requires additional work contributing to the manufacturing cost thereof. Furthermore, since the fixed electrodes provided on the membrane switch element for the LED are formed of soft material such as silver or copper, the fixed electrodes are liable to be damaged by the lead wires of the LED causing an unstable electrical connection between the lead wires and the fixed electrodes. Still further, since the flexible films of the membrane switch element are polyester films or the like, it is impossible to solder the lead wires of the LED to the fixed electrodes. When the flexible films are heat-resistant films such as polyimide films, it is possible to solder the lead wires of the LED to the fixed electrodes. However, polyimide films are more expensive by far than polyester films. Moreover, fastening the LED holder to the base plate with a screw requires additional assembling work.

SUMMARY OF THE INVENTION

Accordingly, it is an object of the present invention to provide a luminous element holding structure capable of being mounted on a supporting plate holding key switches without requiring replacement or modification of the holding plate, capable of maintaining the lead wires of the luminous element, such as an LED, securely in contact with respective fixed electrodes without requiring any expensive heat-resistant material, capable of holding a luminous element without requiring the lead wires of the luminous element to be bent, and capable of securely holding a luminous element in place even if the luminous element is exposed to shocks.

To achieve the objects of the invention, the present invention provides a luminous element holding structure for an illuminated key switch arrangement, comprising a key having a head provided with a transparent window, and a housing for containing switch operating members, the housing having a hollow substantially cubic body, a recess defined by one of the vertical corners of the body, a flange formed on the outer surface of the body, a through hole formed in the upper wall of the body to receive the stem of the key, a partial flange extending in a plane in which the flange is disposed so as to partitioning the recess into an upper portion and a lower portion and provided with a through hole for receiving the luminous head of a luminous element, and a pair of catches formed below the flange, respectively, on the opposite side faces of the body, a holding plate provided with through holes each for receiving the lower portion of the housing, a base plate, a switch element having pairs of switch contacts, and pairs of fixed electrodes each for conducting current to a luminous element, and disposed on the base plate, and a luminous element holder having an external shape conforming to that of the recess and consisting of an insulating member and a pair of conductive members attached to the insulating member so as to be insulated from each other by the insulating member and each having a through hole for receiving one of the lead wires of a luminous element.

The lead wires of the luminous element are inserted in the holes formed, respectively, in the conductive members of the luminous element holder to hold the luminous element firmly in the luminous element holder. Then, the luminous element holder holding the luminous element is set in the recess formed in the housing in a manner in which the luminous head of the luminous element is inserted from below and through a luminous element receiving hole formed in the housing, and then the housing combined with the luminous element holder holding the luminous element is inserted in the through hole formed in the holding plate so that the conductive members of the luminous element holder are pressed firmly and respectively against the fixed electrodes for electrically connecting the luminous element to the fixed electrodes when the holding plate is combined with the base plate. When the housing is fitted in the through hole in the holding plate, the catches engage the edge of the plate defining the through hole to fasten the housing firmly to the holding plate.

Thus, the through holes formed in the holding plate are able to receive the housing of a key switch whether or not the key switch is provided with a luminous element, and hence any key switch provided on the holding plate can be optionally provided with a luminous element.

Furthermore, since the lead wires of a luminous element are connected to the conductive members of the luminous element holder under pressure without using any particular connecting means such as soldering and without being bent, the connection of the lead wires and the conductive members is resistant to shocks and can be made at a low cost.

The above and other objects, features and advantages of the present invention will become apparent from the following description taken in conjunction with the accompanying drawings.

BRIEF DESCRIPTION OF THE DRAWINGS

FIGS. 6(A) and 6(B) are sectional views of a conventional key switch;

DETAILED DESCRIPTION OF THE PREFERRED EMBODIMENTS

A luminous element holding structure, in a preferred embodiment according to the present invention, will be described hereinafter with reference to FIGS. 1 through 5 by way of an example in which a luminous element held by the structure is a light emitting diode (hereinafter abbreviated as "LED"), and hence the luminous element holding structure will be referred to as an LED holding structure.

Figure 1:
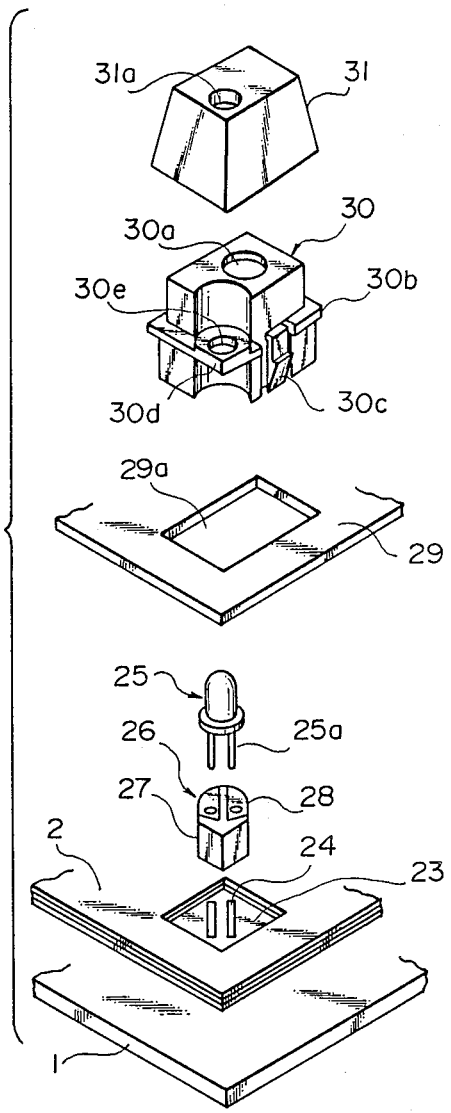
FIG. 1 is an exploded perspective view of an illuminated key switch incorporating a luminous element holding structure, in a preferred embodiment, according to the present invention.

Referring to FIG. 1, a membrane switch element 2, which is a known element employed in a conventional membrane keyboard, is provided with a hole 23 at a predetermined position, and a pair of fixed electrodes 24 are provided on the surface defining the bottom the hole 23. An LED 25 has a pair of lead wires 25*a* which are bent toward each other so that the distance between the respective roots of the lead wires 25*a* is smaller than that between the respective extremities of the same. An LED holder 26 comprises an insulating member 27 having the shape of an arrow and including a head section having the shape of an arrow head and a leg section projecting from the head section, and a pair of conductive members 28 attached respectively to the opposite sides of the leg section of the insulating member 27. The conductive members 28 are provided respectively, with a through hole 28*a* for receiving one of the pair of lead wires 25*a* of the LED 25. Both the insutating member 27 and the conductive members 28 are formed of an elastic material or elastic materials. A holding plate 29 is provided with through holes 29*a* each for receiving a housing 30. The shape of the through holes 29*a* conforms to the external shape of the lower portion of the housing 30. The housing 30 has a substantially cubic body provided with an upper wall having a through hole 30*a* for receiving the stem of a key, a flange 30*b* formed at the outer side surface thereof substantially in the middle portion thereof, and a pair of resilient catches 30*c* formed below the flange 30*b* on the opposite side faces thereof to fasten the housing 30 to the holding plate 29. One of the four corners of the housing defines a recess having the shape of a quarter of a cylindrical surface and partitioned by a partial flange 30*d*. A through hole 30*e* for receiving the luminous head of the LED 25 is formed in the partial flange 30*d*.

A key 31 has a hollow prismoidal key head provided with a window 31*a* formed of transparent material at a position corresponding to the LED 25 and is supported by the housing 30 when the key 31 is combined with the housing 30. The key switch to be operated by the key 31 is substantially conventional, and hence the description thereof will be omitted.

Figure 4A:
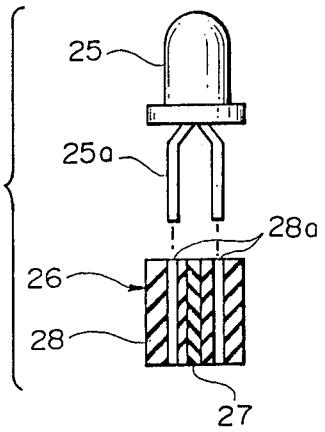
FIG. 4 is an explanatory diagram illustrating the manner of combining a luminous element and the luminous element holder of the luminous element holding structure of FIG. 1.
Figure 4B:
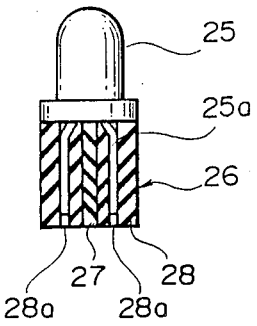
Figure 5:
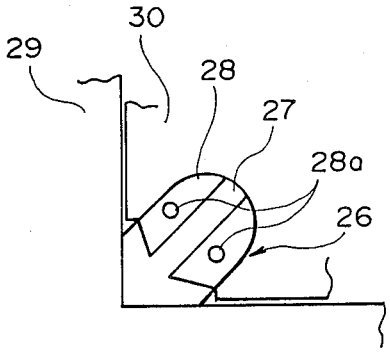
FIG. 5 is a fragmentary bottom view showing the luminous element holder of the luminous element holding structure of FIG. 1 as mounted on a holding plate.
Figure 7:
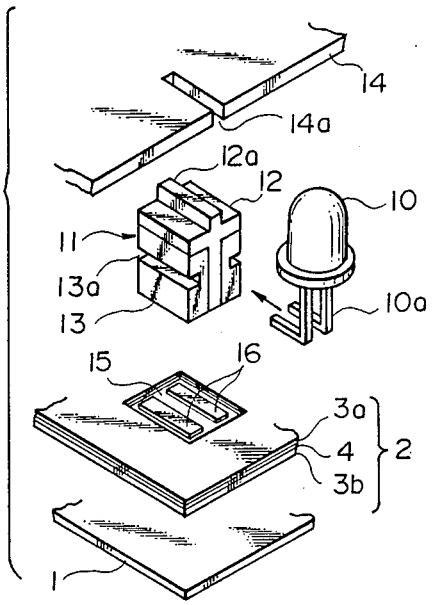
FIG. 7 (PRIOR ART)
FIG. 7 is an exploded perspective view of a conventional luminous element holding structure.
Figure 8:
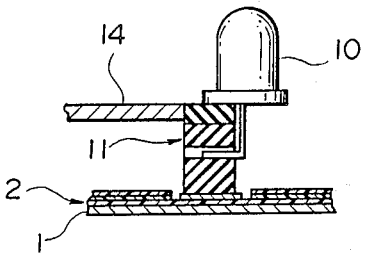
FIG. 8 (PRIOR ART)
FIG. 8 is a sectional view of the conventional luminous element holding structure of FIG. 7 as mounted on a holding plate.
Figure 9:
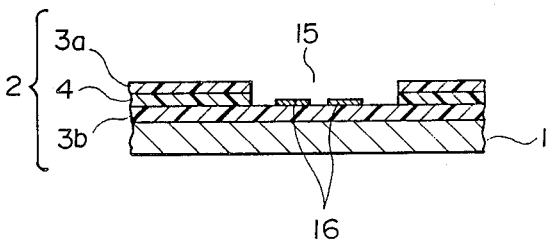
FIG. 9 (PRIOR ART)
FIG. 9 is a sectional view of a membrane switch element provided with a pair of fixed electrodes for conducting current to a luminous element.
Figure 10:
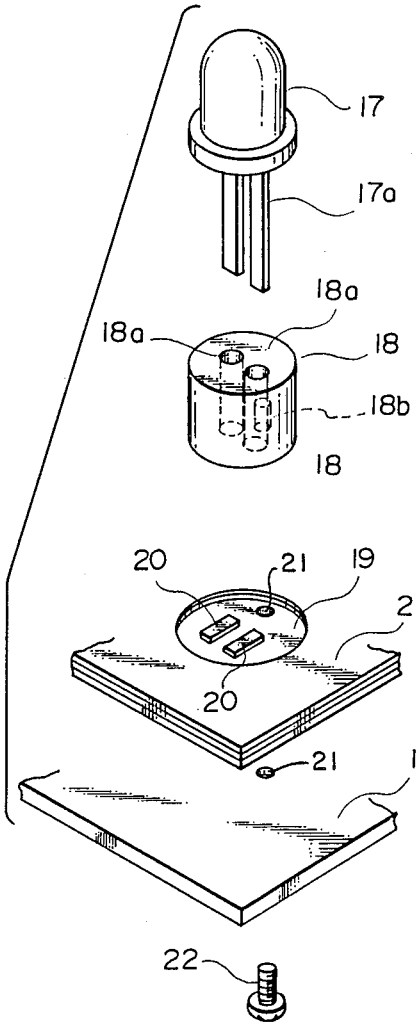
FIG. 10 (PRIOR ART)
FIG. 10 is an exploded perspective view of another conventional luminous element holding structure.
Figure 11:
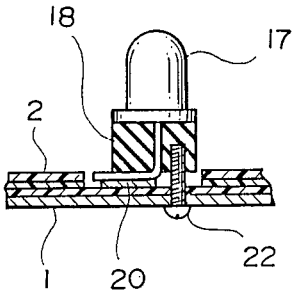
FIG. 11 (PRIOR ART)
FIG. 11 is a sectional view of the luminous element holding structure of FIG. 10.

Referring to FIG. 4, the lead wires 25*a* of the LED 25 are inserted forcibly and respectively in the through holes 28*a* of the conductive members 28 of the LED holder 26. Since the distance between the respective roots of the lead wires 25*a* is smaller than that between the extremities of the lead wires 25*a* and since the conductive members 28 are elastic, the LED 25 is held firmly on the LED holder 26 when the lead wires 25*a* are inserted in the through holes 28*a* to the roots thereof resiliently deforming the elastic conductive members 28.

Then, the luminous head of the LED 25 thus firmly held on the LED holder 26 is inserted from below and through the through hole 30*e* formed in the partial flange 30*d* of the housing 30 so that the LED holder 26 is disposed in the lower portion of the recess defined in the housing 30. The lower portion of the housing 30 is then inserted in the through hole 29*a* of the holding plate 29 so that the flange 30*b* of the housing 30 is seated on the upper surface of the holding plate 29 and so that the catches 30*c* engage the edge defining the through hole 29*a* to secure the housing 30 firmly in the through hole 29*a*. In this state, the head section having the shape of an arrow head of the insulating member 27 of the LED holder 26 fits against a corner of the plate 29 defining the through hole 29*a* as shown in Dig. 5 to insulate the conductive members 28 of the LED holder 26 from the conductive holding plate 29 and to prevent the dislocation of the LED holder 26.

Figure 2:
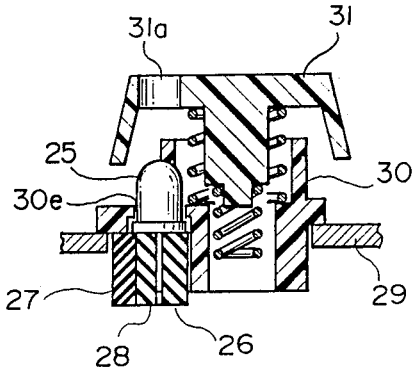
FIG. 2 is a sectional view of the illuminated key switch of FIG. 1.
Figure 3:
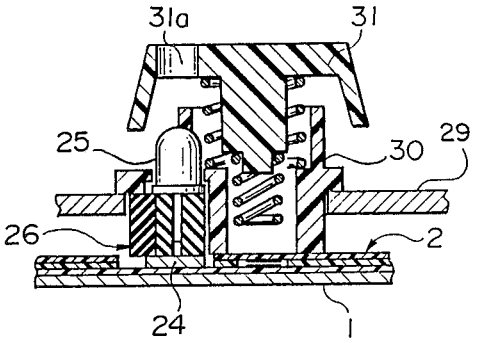
FIG. 3 is a sectional view of the illuminated key switch of FIG. 1 as mounted on a base plate provided with a membrane switch element.

Referring to FIG. 2, when the key 31 is combined with the housing 30 combined with the LED holder 26 holding the LED 25, the stem of the key 31 is inserted in the housing 30 through the through hole 30*a* so that the transparent window 31*a* of the key 31 is located directly above the LED 25. Therefore, light is emitted through the window 31*a* when the LED 25 is lit.

The assembly of the LED 25, the LED holder 26, the holding plate 29, the housing 30 and the key 31 is mounted on the base plate 1 so that the conductive members 28 of the LED holder 26 are pressed, respectively, against the fixed electrodes 24 provided on the surface of the membrane switch element 2 defining the bottom of hole 23. Thus, the LED is connected electrically through the conductive members 28 of the LED holder 26 to the fixed electrodes 24, and the key 31 is associated with a corresponding pair of contacts to form an illuminated key switch.

When the key 31 is depressed properly to make a circuit, the illuminated key switch is closed and electricity is supplied through the fixed electrodes 24 to the LED 25 to light up the LED. Thus, the proper depression of the key 31 can be confirmed by recognizing the emission of light from the LED 25.

In this embodiment, the insulating member 27 of the LED holder 26 has the shape of an arrow and the conductive members 28 are attached to the opposite sides of the leg section of the insulating member 27. However, the shape and construction of the LED holder are not limited thereto and may have any shape and any structure provided that the conductive members are insulated from each other and from the holding plate by the insulating member.

Although the present invention has been described as applied to an illuminating key switch using a membrane switch element, the present invention is applicable also to an illuminated key switch using a printed circuit board having fixed capacitance electrodes.

And, although the invention has been described in its preferred form with a certain degree of particularity, obviously many changes and modifications are possible therein. It is therefore to be understood that the present invention may be practiced otherwise than specifically described herein without departing from the scope and spirit thereof.

What is claimed is:

1. A luminous element holding structure of an illuminated key switch, said structure comprising:

a base plate;

a switch element disposed on said base plate, said switch element having a pair of contacts, a switch element recess extending therein, and a pair of electrodes fixed thereto in said recess;

a holding plate disposed over said switch element and having a holding plate through hole extending therethrough;

a housing mounted to said holding plate within said holding plate through hole and resting on said switch element, said housing having a hollow substantially cubic body with a housing recess defined in one corner thereof, a peripheral flange extending around said body at a mid-portion thereof and seated on a surface of said holding plate, a housing through hole extending through the upper wall of the cubic body, a pair of catches disposed on opposite sides of said cubic body and engaging said holding plate at a surface thereof opposite the surface of said holding plate on which said peripheral flange is seated, and a partial flange extending in said housing recess along a plane common to a plane in which said peripheral flange is disposed and partitioning said housing recess into an upper recess portion and a lower recess portion, said partial flange having a partial flange through hole extending therethrough;

a key movably supported by said housing for actuating said pair of contacts, said key having a hollow substantially prismoidal head including a transparent window, and a stem extending from said head toward said contacts;

a luminous element holder having a first portion adjacent said housing in said lower recess portion and a second portion adjacent an edge of said switching element defining said switching element recess, said first portion having a shape complimentary to said lower recess portion, said luminous element holder comprising an insulating member and a pair of conductive members, said insulating member including a head portion that is adjacent said edge of said switching element, has a shape complimentary thereto and constitutes the entire said second portion of the luminous holder, and a leg portion extending from said head portion, said conductive members attached to said insulating member, disposed at opposite sides of said leg portion, contacting said electrodes, respectively, and each having a holder through hole extending therein; and a luminous element including a luminous head extending through said partial flange through hole, and a pair of lead wires each of which extends form said luminous head into a respective said holder through hole.

2. A luminous element holding structure as claimed in claim 1, wherein said insulating member comprises elastic insulative material, and said conductive members comprise elastic conductive material.

3. A luminous element holding structure as claimed in claim 1, wherein said conductive members are resiliently deformed around said lead wires thereby resiliently securing said luminous element to said luminous element holder.

* * * * *